US006586117B2

(12) United States Patent
Nomura et al.

(10) Patent No.: US 6,586,117 B2
(45) Date of Patent: Jul. 1, 2003

(54) STEEL SHEET HAVING EXCELLENT WORKABILITY AND SHAPE ACCURACY AND A METHOD FOR ITS MANUFACTURE

(75) Inventors: Shigeki Nomura, Kashima (JP); Hiroyuki Nakagawa, Anjo (JP); Yoshiaki Nakazawa, Takarazuka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/981,986

(22) Filed: Oct. 19, 2001

(65) Prior Publication Data

US 2003/0099857 A1 May 29, 2003

(51) Int. Cl.[7] ..... B32B 15/01; C22C 38/18; C21D 9/46

(52) U.S. Cl. ..... 428/659; 148/333; 148/334; 148/337; 148/518; 148/522; 148/533; 148/540; 148/546; 148/601; 148/602; 148/653; 148/654; 148/661; 148/662; 420/104; 420/105; 420/123

(58) Field of Search ..... 428/659; 420/104, 420/105, 123; 148/333, 334, 337, 518, 522, 533, 540, 546, 601, 602, 653, 654, 661, 662

(56) References Cited

U.S. PATENT DOCUMENTS 6,312,536 B1 * 11/2001 Omiya et al. ..... 428/659

FOREIGN PATENT DOCUMENTS

| | | | |
|---|---|---|---|
| JP | 2-111841 | A | 4/1990 |
| JP | 4-173945 | A | 6/1992 |
| JP | 11-131145 | A | 5/1999 |
| JP | P2000-109965 | A | 4/2000 |

* cited by examiner

*Primary Examiner*—Robert R. Koehler
(74) *Attorney, Agent, or Firm*—Burns, Doane, Swecker & Mathis, LLP

(57) ABSTRACT

A steel for forming a high strength steel sheet contains, in mass %, C: at most 0.04%, Si: at most 0.4%, Mn: 0.5–3.0%, P: at most 0.15%, S: at most 0.03%, Al: at most 0.50%, N: at most 0.01%, and Mo: 0.01–1.0%. Steel sheet formed from the steel is suitable for use as automotive panels.

28 Claims, No Drawings

STEEL SHEET HAVING EXCELLENT WORKABILITY AND SHAPE ACCURACY AND A METHOD FOR ITS MANUFACTURE

BACKGROUND OF THE INVENTION

1. Field of the Invention

The present invention relates to a high strength cold rolled steel sheet and a high strength zinc-coated steel sheet suitable for use in parts such as automotive panels which require a good external appearance, good workability, and good shape accuracy, i.e., shape retention. The present invention also relates to a steel for preparing such a steel sheet and to a method for manufacturing the steel sheet.

2. Description of the Related Art

Automotive panels and other exterior members of automobiles are required to have an excellent appearance and a good strength exemplified by dent resistance. A primary cause of flaws in the external appearance of such panels is surface strains caused by elastic restoration after press forming. Therefore, a material having a low yield strength is suitable for such panels. However, if the yield strength of a panel after forming is too low, the panel has poor dent resistance, and indentations remain when the panel is pressed with a finger.

Japanese Published Unexamined Patent Application Hei 2-111841(1990) discloses a steel sheet which is soft at the time of forming and which has a yield stress which increases at the time of bake finishing after forming. However, due to a deterioration of strain aging properties of the steel sheet, there is a practical limit to the extent to which the yield stress of that steel sheet can be increased.

A multi-phase structure steel sheet is known to have good strain aging properties and a good bake hardenability. Japanese Published Unexamined Patent Application Hei 4-173945(1992) describes a method for the manufacture of such a steel sheet. However, in order to manufacture a steel sheet with a multi-phase structure, it is necessary to add large amounts of C or Mn, so the yield strength of the steel sheet becomes too high, and it is difficult to use the steel sheet in automotive panels.

Japanese Published Unexamined Patent Application No. 2000-109965 discloses a method of manufacturing a steel sheet having a multi-phase structure and a low yield strength. However, the steel sheet has a low r-value, so it is not completely satisfactory with respect to formability.

SUMMARY OF THE INVENTION

The present invention provides a steel suitable for forming cold rolled steel sheet and zinc-coated steel sheet having the ability to undergo aging at room temperature (strain aging), good shape accuracy, good dent resistance, and good press-formability and which can be utilized for exterior members of automobiles. The present invention also provides a method for the manufacture of this steel sheet.

A method of improving the formability of a steel sheet with a multi-phase structure by retaining austenite has already been disclosed in Japanese Published Unexamined Patent Application Hei 11-131145(1999), for example. However, according to that disclosure, in order to obtain retained austenite, it is necessary to add large amounts of Si or Al. In a method in which the amount of bainite is made extremely large, the yield strength becomes too high, and it becomes easy for stretcher strains to occur, so the resulting sheet is not appropriate for application to automotive panels.

Furthermore, if the amount of Si is made too high, in hot dip galvanizing, there are problems with respect to the wettability at the time of manufacture and with respect to the ability to perform galvannealing (alloying treatment).

The present inventors found that by adding a suitable amount of Mo to a steel with a reduced level of C, during tension of the steel sheet in the direction perpendicular to rolling, a low yield point of at most 300 MPa, which is a suitable for application to automotive panels, is realized. Furthermore, they found that by maintaining this steel in a prescribed temperature range after annealing, a suitable amount of austenite is retained. By forming a metal structure substantially of ferrite and a bainite/martensite hard phase and retained austenite, adequate workability can be guaranteed without a deterioration in strain aging properties.

According to one form of the present invention, a steel for use in forming high strength steel sheet comprises, in mass %, C: at most 0.04%, Si: at most 0.4%, Mn: 0.5–3.0%, P: at most 0.15%, S: at most 0.03%, Al: at most 0.50%, N: at most 0.01%, and Mo: 0.01–1.0%.

The steel may further include at least one of Cr: less than 1.5%, Ti: at most 0.15%, Nb: at most 0.15%, and B: at most 0.01%.

In preferred embodiments, the steel has a metal structure containing retained austenite with a volume ratio of at least 0.5% and less than 10%, and a remainder which is a multi-phase structure of ferrite and a hard phase of at least one of bainite and martensite.

The steel may be formed into a high strength cold rolled steel sheet suitable for use as an automotive panel. In preferred embodiments, in a tensile test in a direction perpendicular to the rolling direction of the cold rolled steel sheet, the yield point is at most 300 MPa, the amount of work hardening with a 2% prestrain and the amount of BH are both at least 30 MPa, and the yield ratio is at most 75%.

The cold rolled steel sheet may be subjected to zinc coating by a variety of plating methods to form a zinc-coated steel sheet.

According to another form of the present invention, a method of manufacturing a high strength galvanized steel sheet includes casting a slab of the above-described steel, performing hot rough rolling either directly or after heating to a temperature of at most 1300° C., commencing hot finish rolling either directly or after reheating or holding, completing finish rolling at a temperature of at least 780° C., performing coiling after cooling to a temperature of 750° C. or below at an average cooling rate of at least 3° C./second, optionally performing cold rolling either directly or after scale removal, heating to an annealing temperature of at least 700° C. and then cooling to a temperature of 600° C. or below at an average cooling rate of at least 3° C./second, holding in a temperature range of 450–600° C. for at least 10 seconds, performing hot dip galvanizing after cooling, and then optionally carrying out alloying.

According to another form of the present invention, a method of manufacturing a high strength steel sheet includes casting a slab of the above-described steel, performing hot rough rolling either directly or after heating to a temperature of at most 1300° C., commencing hot finish rolling either directly or after reheating or holding, completing finish rolling at a temperature of at least 780° C., performing coiling after cooling to a temperature of 750° C. or below at an average cooling rate of at least 3° C./second, optionally performing cold rolling either directly or after scale removal, heating to an annealing temperature of at least 700° C. and then cooling to a temperature of 600° C. or below at an average cooling rate of at least 3° C./second, holding in a temperature range of 250–600° C. for at least 10 seconds, and then cooling. If desired, the resulting steel sheet may be electroplated with a metal or an alloy having zinc as a primary component to obtain a high strength zinc-coated steel sheet.

DESCRIPTION OF PREFERRED EMBODIMENTS

A steel according to the present invention can be used to form a cold rolled steel sheet, or a zinc-coated steel sheet formed from either a cold rolled steel sheet or a hot-rolled steel sheet. In the present invention, any type of Zn-based plating can be used. Zinc-coated steel sheet according to the present invention can be produced by various types of manufacturing methods such as hot dip plating, electroplating, vapor deposition plating, and flame spraying. The plating composition can be, for example, pure Zn, a composition having Zn as a primary component such as Zn—Fe, Zn—Ni, Zn—Al, Zn—Mn, Zn—Cr, Zn—Ti, or Zn—Mg, or it may be a composition including one or more other alloying elements and impurity elements for improving corrosion resistance or other property, such as Fe, Ni, Co, Al, Pb, Sn, Sb, Cu, Ti, Si, B, P, N, S, or O. In addition, fine ceramic particles such as $SiO_2$ or $Al_2O_3$, oxides such as $TiO_2$ or $BaCrO_4$, or an organic polymer such as an acrylic resin may be dispersed in the plating layer. The plating may have a uniform composition in the thickness direction of the plating layer, or the composition may vary continuously or layer by layer. For a multi-layer plated steel sheet, the plating composition of the outermost layer may be pure Zn or one having Zn as a primary component such as Zn—Fe, Zn—Ni, Zn—Al, Zn—Mn, Zn—Cr, Zn—Ti, or Zn—Mg, it may further include one or more alloying elements or impurity elements for improving a property such as corrosion resistance, and if necessary fine ceramic particles such as $SiO_2$ or $Al_2O_3$, oxides such as $TiO_2$ or $BaCrO_4$, or an organic polymer such as an acrylic resin may be dispersed in the plating layer.

Some examples of a plated steel sheet are a hot-dipped galvanized steel sheet, a vapor deposited zinc-coated steel sheet, hot-dipped iron-zinc galvannealed steel sheet, a hot-dipped zinc-coated steel sheet in which the plating is an alloy of zinc as a primary component with aluminum, iron, or the like, hot-dipped galvannealed steel sheet in which the lower layer in the cross-sectional direction of the plating is alloyed (generally referred to as a half-alloy), a plated steel sheet having on one side a hot-dipped galvannealing which is an alloy of iron and zinc and having on its other side a hot-dipped galvanizing, a steel sheet in which plating of zinc or plating having zinc as a main component and containing iron or nickel is plated atop one of the above-described platings by electroplating, vapor deposition plating, or the like, an electrodeposited zinc-coated steel sheet, an electroplated steel sheet plated with an alloy of zinc, nickel, chromium, or the like, electroplated steel sheet having a single alloy layer or multiple alloy layers, or a steel sheet plated by vapor deposition plating of zinc or a zinc-containing metal. In addition, it may be a plated steel sheet in which ceramic fine particles such as $SiO_2$ or $Al_2O_3$, fine oxide particles such as $TiO_2$ or $BaCrO_4$, or organic polymers are dispersed in a zinc or zinc alloy plating.

The reasons for the limitations on the steel composition according to the present invention and on the manufacturing conditions for a steel sheet according to the present invention will be described below in detail. When referring to the steel composition, unless otherwise specified, "%" means "mass %".

(A) Steel Composition

C: C is necessary in order to obtain a multi-phase structure and retained austenite. However, if the C content is greater than 0.04%, the yield strength of the steel sheet becomes too high, and it is not suitable for use for automotive panels. Accordingly, the C content is made at most 0.04%. Preferably it is at least 0.001%, more preferably it is at least 0.005%, and still more preferably it is at least 0.01%.

Si: Si is effective for increasing strength, but it brings about a decrease in toughness and a worsening of the surface condition. Furthermore, it stabilizes austenite, so the amount of retained austenite increases. During the manufacture of a zinc-coated steel sheet, Si impedes the wettability of plating and impedes galvannealing treatment (alloying treatment). Accordingly, the upper limit on the Si content is 0.4%. The upper limit is preferably 0.2% and more preferably 0.1%.

Mn: The addition of at least 0.5% of Mn is necessary in order to obtain a multi-phase structure. However, if the Mn content exceeds 3.0%, the yield strength of the steel sheet becomes too high, and it becomes unsuitable for use for automotive panels. Accordingly, the Mn content is 0.5–3.0%. Preferably it is 1.0–2.0%.

P: P is advantageous for increasing strength, but addition of a large amount of P worsens weldability. Accordingly, the upper limit on the P content is 0.15%. The P content is more preferably less than 0.05%. The total amount of P and C, which worsens weldability, is preferably less than 0.08% and more preferably less than 0.05%.

S: S causes hot embrittlement and deteriorates surface quality, so it is an undesirable element. Therefore, the amount thereof is preferably as low as possible, and the S content is made at most 0.03%.

N: N diffuses rapidly, so it has a large affect on a deterioration of properties caused by aging at room temperature. Accordingly, the N content is preferably low, and the upper limit is made 0.01%.

Al: Al is added in order to carry out deoxidation of steel at the time of preparation of a molten steel. However, the effect of Al saturates when a large amount thereof is added, and costs merely increase without a corresponding improvement in properties, so the upper limit on the Al content is made 0.50%. Preferably the Al content is at most 0.10%. Al also has the effect of reducing the amount of solid solution N by forming a nitride, so preferably at least 0.005% of Al is added.

Mo: In the present invention, by adding at least 0.01% of Mo, a multi-phase structure steel sheet including retained austenite having a low yield strength suitable for automotive panels can be obtained. However, if the Mo content exceeds 1.0%, the yield strength of the steel sheet becomes too high, so the upper limit is made 1.0%. Accordingly, the amount of Mo which is added is 0.01–1.0% and preferably 0.1–0.6%.

B: B has the effect of reducing solid solution N by forming a nitride, so it may be added if necessary. However, the effect of B saturates when a large amount thereof is added, and costs merely increase without a corresponding improvement in properties, so the upper limit is made 0.01%.

Cr: Cr promotes formation of a multi-phase structure, so it may be added if necessary. However, the effect thereof saturates when 1.5% or above is added, so the Cr content is made less than 1.5%. Preferably it is less than 1.0%.

Ti: Ti has the effect of fixing N, which promotes aging deterioration, so Ti may be added if necessary. However, when the Ti content exceeds 0.15%, there is the problem that the yield point increases due to precipitation hardening. Accordingly, the Ti content is made at most 0.15%. Preferably it is at most 0.03%.

Elements other than those described above may be added in an amount within a range in which they do not cause a deterioration in the properties which the present invention attempts to improve. For example, Cu, Ni, and the like may be added each in an amount of at most 0.1%, Nb may be added in an amount of at most 0.15%, and V, Ca, Sn, Sb, and the like may also be added,each in an amount of at most 0.03%.

(B) Metal Structure

In a preferred embodiment, the metal structure of a steel according to the present invention contains retained austenite with a volume ratio (below "%" with respect to the metal structure refers to the volume ratio) of at least 0.5% and less than 10%. The problem of a low r-value and poor formability of a multi-phase structure steel sheet can be solved by increasing the elongation through the TRIP (transformation induced plasticity) effect of retained austenite. In order to obtain this effect, it is necessary for the amount of retained austenite to be at least 0.5%. A high degree of work hardening is obtained from the TRIP effect, so the amount. of work hardening with a 2% prestrain, which is effective for dent resistance, is also high. However, if the volume ratio is 10% or above, large strains resulting from a large amount of work hardening are excessively obtained, the strength becomes too high, and ductility decreases, so it becomes easy for yield point elongation (YPE), which worsens surface quality, to occur. Preferably the volume ratio of retained austenite is in the range of 0.5–5% and more preferably it is 0.5–4%.

In this preferred embodiment, it is desirable for the remainder of the metal structure to be a multi-phase structure of ferrite and a hard phase. The hard phase preferably has a Vickers hardness of at least 200 HV and it is bainite and/or martensite, but it is preferably primarily martensite.

By forming a multi-phase structure of ferrite and a hard phase, a high strength cold rolled steel sheet or a high strength zinc-coated steel sheet can be obtained which has a yield point of at most 300 MPa, work hardening(WH) with a 2% prestrain and BH each of at least 30 MPa, and a yield ratio of at most 75% during tension in a direction perpendicular to the rolling direction, and which has excellent strain aging properties and excellent formability and shape retention. Preferably the yield point is at most 280 MPa, the tensile strength is at most 510 MPa, the amount of WH is at least 50 MPa, and the amount of BH is at least 50 MPa. More preferably the yield point is at most 250 MPa.

(C) Hot Rolling Conditions

Hot rough rolling is commenced directly after continuous casting or after heating to a temperature of at most 1300° C. or after holding at the cast slab temperature. After the completion of hot rough rolling, finishing rolling is commenced either immediately after rough rolling or if necessary after performing reheating of the rough bar or performing the holding. Finish rolling is completed at a temperature of at least 780° C., and coiling is performed after cooling to a temperature of 750° C., or less at an average rate of at least 3° C. per second.

Hot rough rolling of a slab which is manufactured by continuous casting may be directly commenced at a high temperature, or rolling may be commenced after heating to at most 1300° C. or after holding. When heating or holding is carried out, the temperature is made at most 1300° C. in order to coarsen precipitates and to increase the r-value. It is preferable to decrease the temperature, and it is preferably at most 1200° C. and more preferably at most 1100° C.

After the completion of rough rolling, finish rolling is commenced, and rolling is completed at a finishing temperature of at least 780° C. As described above, if the slab heating temperature is decreased, it is difficult to maintain the finishing temperature. As a means of avoiding this problem, it is extremely effective to reheat or hold the temperature of all or a portion of the rough bar prior to beginning finish rolling. As a method of heating or holding, the rough bar can be wound into the shape of a coil and placed into a furnace, or the rough bar can be heated by a rough bar heater which heats the rough bar by induction heating, it can be heated with a gas burner, or a conductive heating method in which a current is passed directly through the rough bar can be used. A heating method using a rough bar heater is particularly preferred.

Prior to finish rolling, it is advantageous to join a plurality of rough bars together and then to carry out continuous rolling because finishing can be carried out at a high speed in a short period of time without too great a decrease in speed.

If the finishing temperature falls below 780° C., the amount of an unsuitable texture increases in the hot rolled steel sheet and the r-value of the final product decreases, which is undesirable. Preferably the finishing temperature is at least 820° C. and more preferably at least 850° C.

After finish rolling, cooling is carried out to 750° C. or below at an average cooling rate of at least 3° C. per second, and then coiling is carried out. Rapid cooling at a rate of at least 3° C. per second to 750° C. or below is carried out in order to refine ferrite crystal grains. If the crystal grains are coarse, carbides easily precipitate after annealing, and retained austenite and a hard phase of bainite or martensite are not obtained. In order to refine the crystal grains or obtain a bainite structure, the cooling rate is preferably 10° C. per second or higher, and the coiling temperature is preferably 300–600° C. and more preferably 400–550° C.

(D) Annealing Conditions

After hot rolling, scale removal is carried out, and if necessary, cold rolling is performed. Scale removal is normally carried out by pickling. Either before or after scale removal, leveling may be carried out by skin pass rolling or with a leveler.

Cold rolling can be carried out by ordinary methods. The reduction is preferably at least 40%, since this provides a suitable texture.

After cold rolling, annealing is carried out by continuous annealing or with a continuous hot dip galvanizing line. Annealing is carried out by heating to at least 700° C., and normally by heating to at least 720° C. which is above the $Ac_1$ point. In order to adequately guarantee a hard phase for preventing a deterioration in strain aging properties, the annealing temperature is preferably at least 780° C. and more preferably at least 820° C.

Subsequent to annealing, after cooling is carried out to a temperature of 600° C. or below at an average cooling rate of a least 3° C. per second, it is important to perform holding in a range of 250–600° C. for at least 10 seconds. If the cooling rate is less than 3° C. per second, austenite can be decomposed into pearlite or cementite during the cooling process, so a multi-phase structure having satisfactory room temperature aging properties is not obtained. Preferably the cooling rate is 8–120° C. per second. After cooling, it is important to perform holding in a range of 250–600° C. for at least 10 seconds. Due to this holding, austenite does not break down into cementite, and the austenite is stabilized by concentration of austenite stabilizing elements such as C. Preferably the holding is carried out in a temperature range of 300–600° C. for 10–18 seconds, and more preferably in the range of 450–600° C. for 10–60 seconds.

When manufacturing a hot-dipped galvanizing steel sheet, if the holding temperature is less than 450° C., reheating must be carried out, which is not desirable, so the holding temperature is preferably made 450–600° C.

When carrying out holding, the temperature may be maintained at a constant temperature, or the temperature may be decreased at a rate of at most 2° C. per second during holding.

After holding, the steel sheet can be cooled at a rate of at least 3° C. per second as is or after carrying out hot dip galvanizing or after further carrying out lead-zinc alloying treatment, i.e., galvannealing. If the cooling rate is less than 3° C. per second, austenite breaks down into pearlite or cementite during the cooling process, and a multi-phase structure having good strain aging properties is not obtained.

Next, skin pass rolling may be carried out with a reduction of at most 2.0% in order to adjust the surface roughness or to carry out leveling. Steel sheet which has been cooled as is after holding may have its surface electroplated with plating primarily comprising zinc. A lubricating conversion coating may be formed or oil may be applied to the zinc-coated steel sheet. From the standpoint of sliding properties, the roughness of the surface is preferably an average surface roughness Ra of at most 1.2 micrometers and more preferably at most 1.0 micrometers.

EXAMPLES

Next, the effects of the present invention will be described in greater detail with respect to the following examples.

Example 1

In this example, a steel having the chemical composition shown in Table 1 was melted in a laboratory, and a slab having a thickness of 80 mm was manufactured.

The resulting slab was hot rolled under the conditions shown in Table 2 to a thickness of 3 mm. The rough rolling during the hot rolling comprised performing four passes with an interval of at least 5 seconds between passes to a thickness of 30 mm to simulate a method of manufacturing a rough bar. Finish rolling was carried out by three passes with at most 5 seconds between passes to manufacture a hot rolled steel sheet. For some of the examples, the rough bar was heated by induction heating for up to 60 seconds in order to make the temperature on the entrance side of finish rolling higher than the temperature on the exit side of rough rolling. After finish rolling, cooling was carried out by water spraying to a temperature corresponding to a coiling temperature, and the steel sheet was placed in a furnace at the coiling temperature and furnace cooled at 20° C. per hour to 300° C. or less to simulate coiling.

After scale was removed from the surface of the steel sheet, cold rolling was carried out if necessary, and after annealing was carried out under the continuous annealing conditions or the hot dip galvanizing conditions shown in Table 2, skin pass rolling was carried out. The alloying treatment after hot dip galvanizing was carried out at 500° C. for 30 seconds.

When annealing was carried out under the continuous annealing conditions, the surface of the resulting cold rolled steel sheet was electroplated with a zinc coating.

Test pieces were taken from each of the steels, and the following tests were carried out.

Tensile properties were investigated for a JIS #5 tensile test piece taken from each steel in a direction perpendicular to the rolling direction. The amount of work hardening (WH) with a 2% prestrain and the difference in the stress (BH) between the stress after a 2% prestrain and the yield point after applying heating at 170° C. for 20 minutes were measured.

Heat treatment was carried out at 70° C. for 14 days, and the deterioration in strain aging properties was evaluated based on the YPE and the YPE after heat treatment and based on the decrease in elongation between before and after heat treatment.

The metal structure was corroded using a natal liquid, and then the surface of the test piece was observed with an optical microscope and a SEM. When determination of the metal structure was difficult, observation was carried out with a TEM. The amount of retained austenite was measured with X-rays at a location one-fourth of the way through the thickness of the sheet.

The results are shown in Table 3. As shown in Table 3, the steels of the present invention had a YPE of at most 300 MPa and good room temperature aging properties with a decrease in YPE of at most 0.3% and a decrease in elongation of at most 2% after aging at 70° C. for 14 days. The amounts of WH and BH were both high, and the resistance to dents was excellent.

Run No. 21 exhibited poor spot weldability because the P content is too high.

TABLE 1

| Steel Type | C | Si | Mn | P | S | Al | N | Mo | Cr | Others | Remarks |
|---|---|---|---|---|---|---|---|---|---|---|---|
| A | 0.023 | 0.03 | 1.35 | 0.011 | 0.0021 | 0.034 | 0.0026 | 0.21 | 0.65 | | Present |
| B | 0.018 | <0.01 | 1.45 | 0.021 | 0.0086 | 0.023 | 0.0032 | 0.32 | 0.39 | | Invention |
| C | 0.039 | 0.06 | 1.06 | 0.032 | 0.0008 | 0.062 | 0.0028 | 0.18 | 0.63 | | |
| D | 0.026 | 0.32 | 1.21 | 0.008 | 0.0042 | 0.051 | 0.0032 | 0.26 | 0.48 | | |
| E | 0.034 | 0.06 | 1.81 | 0.009 | 0.0019 | 0.032 | 0.0012 | 0.18 | 0.21 | | |
| F | 0.024 | 0.04 | 1.38 | 0.031 | 0.0106 | 0.21 | 0.0092 | 0.19 | 0.53 | | |
| G | 0.026 | 0.01 | 1.34 | 0.009 | 0.0023 | 0.043 | 0.0013 | 0.56 | — | | |
| H | 0.021 | 0.01 | 1.34 | 0.008 | 0.0021 | 0.044 | 0.0026 | 0.19 | 0.42 | B:0.0009 | |
| I | 0.032 | 0.03 | 1.60 | 0.008 | 0.0030 | 0.040 | 0.0051 | 0.22 | 0.40 | Ti:0.021 | |
| J | 0.007 | 0.01 | 1.65 | 0.022 | 0.0032 | 0.043 | 0.0036 | 0.18 | 0.31 | B:0.0008 | |
| K | 0.064* | 0.01 | 1.21 | 0.018 | 0.0023 | 0.024 | 0.0021 | 0.21 | 0.64 | | Compara- |
| L | 0.031 | 0.67* | 1.33 | 0.012 | 0.0008 | 0.043 | 0.0016 | 0.26 | 0.58 | | tive |
| M | 0.021 | 0.06 | 3.21* | 0.008 | 0.0012 | 0.041 | 0.0031 | 0.32 | 0.48 | | |
| N | 0.014 | 0.02 | 1.26 | 0.151* | 0.0013 | 0.026 | 0.0026 | 0.18 | 0.36 | | |
| O | 0.022 | 0.06 | 1.43 | 0.014 | 0.0011 | 0.032 | 0.0041 | 0.005* | 0.64 | | |

*Outside of the range of the present invention

TABLE 2

| Run No. | Steel Type | Hot Rolling Conditions: Heating Temp. (° C.) | Rough Rolling Final Temp (° C.) | Entry Side Temp. for Finishing (° C.) | Finishing Temp. (° C.) | Cooling Rate (° C./sec) | Coiling Temp. (° C.) |
|---|---|---|---|---|---|---|---|
| 1 | A | 1220 | 1060 | 1020 | 840 | 30 | 550 |
| 2 | A | 1280 | 980 | 1020 | 880 | 40 | 500 |
| 3 | A | 1240 | 1060 | 1020 | 880 | 20 | 600 |
| 4 | A | 1200 | 1040 | 1020 | 880 | 10 | 400 |
| 5 | A | 1220 | 1000 | 1040 | 900 | 15 | 550 |
| 6 | A | 1260 | 980 | 1020 | 870 | 20 | 550 |
| 7 | A | 1180 | 1000 | 1040 | 880 | 10 | 500 |
| 8 | A | 1260 | 1060 | 1020 | 880 | 20 | 550 |
| 9 | B | 1240 | 1030 | 1040 | 900 | 10 | 550 |
| 10 | C | 1220 | 1060 | 1020 | 880 | 30 | 450 |
| 11 | D | 1240 | 1040 | 1020 | 900 | 10 | 550 |
| 12 | E | 1220 | 1080 | 1060 | 880 | 20 | 500 |
| 13 | F | 1260 | 1060 | 1020 | 900 | 60 | 400 |
| 14 | G | 1240 | 1040 | 1040 | 880 | 30 | 550 |
| 15 | H | 1220 | 1030 | 1020 | 860 | 10 | 500 |
| 16 | I | 1260 | 1060 | 1020 | 900 | 40 | 600 |
| 17 | J | 1280 | 980 | 1030 | 900 | 10 | 500 |
| 18 | K | 1260 | 1030 | 1020 | 910 | 10 | 550 |
| 19 | L | 1240 | 1040 | 1060 | 910 | 20 | 500 |
| 20 | M | 1260 | 1020 | 1030 | 880 | 20 | 450 |
| 21 | N | 1220 | 1060 | 1040 | 900 | 10 | 500 |
| 22 | O | 1240 | 1030 | 1020 | 910 | 10 | 500 |

| Run No. | Steel Type | Cold Rolling → Annealing Conditions: Hot Rolling Thickness → Cold Rolling Thickness (mm) | Annealing Temp. (° C.) | Cooling Rate (° C./sec) | Temp. at Completion of Cooling (° C.) | Holding Time (sec) | Plating and Post-Treatment | Skin Pass Rolling Elongation (%) | Remarks |
|---|---|---|---|---|---|---|---|---|---|
| 1 | A | 4→0.65 | 880 | 10 | 520 | 30 | Hot Dip | 0.4 | Present |
| 2 | A | 4→0.7 | 860 | 15 | 500 | 20 | Plating → | 0.6 | Invention |
| 3 | A | 1.2→ as hot-rolled | 820 | 10 | 500 | 20 | Alloying | 0.4 | |
| 4 | A | 3.0→0.7 | 840 | 10 | 500 | 30 | | 0.2 | |
| 5 | A | 4→0.7 | 860 | 60 | 350 | 120 | Electroplating | 0.4 | |
| 6 | A | 5→0.7 | 880 | 10 | 510 | 20 | Hot Dip Plating | 0.4 | |
| 7 | A | 4→0.7 | 840 | 10 | 520 | 30 | Hot Dip | 1.2 | |
| 8 | A | 4→0.7 | 880 | 15 | 520 | 30 | Plating → | 0.4 | |
| 9 | B | 3.2→0.7 | 900 | 10 | 520 | 30 | Alloying | 0.6 | |
| 10 | C | 4→0.7 | 860 | 10 | 540 | 30 | | 0.3 | |
| 11 | D | 4→0.7 | 840 | 10 | 560 | 25 | | 0.4 | |
| 12 | E | 4.5→0.7 | 820 | 10 | 560 | 30 | | 0 | |
| 13 | F | 4→0.7 | 840 | 10 | 540 | 40 | | 0.4 | |
| 14 | G | 4→0.7 | 840 | 10 | 520 | 30 | | 0.2 | |
| 15 | H | 4→0.7 | 820 | 10 | 520 | 30 | | 0.4 | |
| 16 | I | 4→0.7 | 840 | 10 | 540 | 30 | | 0.6 | |
| 17 | J | 4→0.7 | 860 | 15 | 540 | 30 | | 0.4 | |
| 18 | K | 4→0.7 | 820 | 10 | 520 | 20 | | 0.4 | Compara- |
| 19 | L | 4→0.7 | 840 | 10 | 420 | 120 | Electroplating | 0.4 | tive |
| 20 | M | 4→0.7 | 880 | 10 | 550 | 30 | Hot Dip | 0.4 | |
| 21 | N | 4→0.7 | 840 | 10 | 540 | 30 | Plating → | 0.4 | |
| 22 | O | 4→0.7 | 820 | 10 | 520 | 30 | Alloying | 0.4 | |

TABLE 3

| Run No. | Steel Type | Metal Structure: Retained Austenite (%) | Primary Structure * | Tensite Properties: YP (MPa) | TS (MPa) | EL (%) | YPE (%) | YP/TS ** | r⁻ Value | WH (MPa) | BH (MPa) | After Aging: YP (MPa) | Reduction in EL (%) | YPE (%) | Remarks |
|---|---|---|---|---|---|---|---|---|---|---|---|---|---|---|---|
| 1 | A | 4 | F + M | 226 | 443 | 32.3 | 0 | 0.51 | 1.6 | 72 | 62 | 228 | 0 | 0 | Present |
| 2 | A | 4 | F + M | 224 | 446 | 32.8 | 0 | 0.50 | 1.3 | 76 | 64 | 225 | 0 | 0 | Invention |
| 3 | A | 3 | F + M | 218 | 443 | 34.6 | 0 | 0.49 | 1.4 | 73 | 61 | 220 | 0 | 0 | |
| 4 | A | 1 | F + M | 216 | 451 | 32.2 | 0 | 0.48 | 1.4 | 76 | 63 | 218 | 0 | 0 | |

TABLE 3-continued

| Run No. | Steel Type | Metal Structure: Retained Austenite (%) | Metal Structure: Primary Structure * | Tensite Properties: YP (MPa) | TS (MPa) | EL (%) | YPE (%) | YP/TS ** | r⁻ Value | WH (MPa) | BH (MPa) | After Aging: YP (MPa) | Reduction in EL (%) | YPE (%) | Remarks |
|---|---|---|---|---|---|---|---|---|---|---|---|---|---|---|---|
| 5 | A | 7 | F + B | 242 | 448 | 31.6 | 0 | 0.54 | 1.3 | 74 | 66 | 245 | 1 | 0 | |
| 6 | A | 4 | F + M | 228 | 462 | 32.6 | 0 | 0.49 | 1.3 | 72 | 64 | 230 | 0 | 0 | |
| 7 | A | 3 | F + M | 232 | 446 | 33.1 | 0 | 0.52 | 1.2 | 71 | 62 | 234 | 0 | 0 | |
| 8 | A | 4 | F + M | 224 | 451 | 32.6 | 0 | 0.50 | 1.3 | 72 | 60 | 229 | 0 | 0 | |
| 9 | B | 3 | F + M | 236 | 461 | 32.4 | 0 | 0.51 | 1.3 | 73 | 61 | 238 | 0 | 0 | |
| 10 | c | 4 | F + M | 224 | 448 | 33.1 | 0 | 0.50 | 1.4 | 72 | 62 | 224 | 0 | 0 | |
| 11 | D | 4 | F + M | 241 | 449 | 33.4 | 0 | 0.54 | 1.4 | 71 | 63 | 243 | 0 | 0 | |
| 12 | E | 4 | F + M | 286 | 503 | 30.1 | 0 | 0.57 | 1.3 | 74 | 62 | 288 | 0 | 0 | |
| 13 | F | 3 | F + M | 226 | 453 | 34.2 | 0 | 0.50 | 1.3 | 73 | 61 | 229 | 0 | 0 | |
| 14 | G | 4 | F + M | 234 | 451 | 33.6 | 0 | 0.52 | 1.4 | 76 | 60 | 239 | 1 | 0.1 | |
| 15 | H | 4 | F + M | 226 | 449 | 33.2 | 0 | 0.50 | 1.4 | 77 | 61 | 228 | 0 | 0 | |
| 16 | I | 4 | F + M | 241 | 443 | 33.1 | 0 | 0.54 | 1.3 | 76 | 64 | 246 | 0 | 0 | |
| 17 | J | 4 | F + M | 226 | 446 | 33.4 | 0 | 0.51 | 1.3 | 72 | 61 | 229 | 0 | 0 | |
| 18 | K | 4 | F + M | 323 | 546 | 27.5 | 0 | 0.59 | 1.4 | 73 | 62 | 229 | 0 | 0 | Compara- |
| 19 | L | 11 | F + M | 321 | 542 | 28.6 | 0 | 0.59 | 1.2 | 72 | 54 | 336 | 3 | 0.4 | tive |
| 20 | M | 4 | F + M | 315 | 526 | 27.3 | 0 | 0.60 | 1.1 | 72 | 61 | 324 | 1 | 0 | |
| 21 | N | 2 | F + M | 236 | 510 | 27.6 | 0 | 0.46 | 1.1 | 71 | 60 | 241 | 0 | 0.1 | |
| 22 | O | 0 | F + M | 306 | 462 | 28.6 | 0 | 0.66 | 1.1 | 28 | 63 | 312 | 1 | 0.1 | |

* F : ferrite, B : bainite, M : martensite, P : pearlite, C : cementite
** : yield ratio

Comparative Example 1

Example 1 was repeated using Steel A of Table 1 except for using the manufacturing conditions shown in Table 4. The results are shown in Table 5.

There comparative examples show that the steel had a high value of YPE, and the amount of WH was small. Furthermore, they show that the steel had a large decrease in elongation due to strain aging, and YPE could be observed.

TABLE 4

| Run No. | Steel Type | Hot Rolling Conditions: Heating Temp. (° C.) | Rough Rolling Final Temp (° C.) | Entry Side Temp. for Finishing (° C.) | Finishing Temp. (° C.) | Cooling Rate (° C./sec) | Coiling Temp. (° C.) | Cold Rolling → Annealing Conditions: Hot Rolling Thickness → Cold Rolling Thickness (mm) | Annealing Temp. (° C.) | Cooling Rate (° C./sec) | Temp. at Completion of Cooling (° C.) | Holding Time (sec) | Plating and Post-Treatment | Skin Pass Rolling Elongation (%) |
|---|---|---|---|---|---|---|---|---|---|---|---|---|---|---|
| 1 | A | 1220 | 940 | 1020 | 720 | 10 | 550 | 4→0.7 | 860 | 15 | 520 | 30 | Hot Dip | 0.4 |
| 2 | A | 1240 | 1060 | 1020 | 880 | 1 | 500 | 4→0.7 | 860 | 10 | 540 | 30 | Plating → | 0.4 |
| 3 | A | 1220 | 980 | 1040 | 880 | 10 | 780 | 4→0.7 | 840 | 10 | 560 | 20 | Alloying | 0.4 |
| 4 | A | 1240 | 1000 | 1040 | 880 | 20 | 550 | 4→0.7 | 690 | 15 | 550 | 30 | | 0.4 |
| 5 | A | 1220 | 1060 | 1020 | 860 | 10 | 550 | 4→0.7 | 840 | 1 | 540 | 30 | | 0.4 |
| 6 | A | 1240 | 1040 | 1020 | 880 | 15 | 550 | 4→0.7 | 880 | 10 | 640 | 30 | | 0.4 |
| 7 | A | 1220 | 1020 | 1040 | 920 | 10 | 500 | 4→0.7 | 790 | 10 | — | — | | 0.4 |

TABLE 5

| Run No. | Steel Type | Tensile Properties: YP (MPa) | TS (MPa) | EL (%) | YPE (%) | YP/TS ** | r⁻ Value | WH (MPa) | BH (MPa) | After Aging: YP (MPa) | Reduction in EL (%) | YPE (%) |
|---|---|---|---|---|---|---|---|---|---|---|---|---|
| 1 | A | 302 | 432 | 29.4 | 0.1 | 0.70 | 0.9 | 27 | 54 | 316 | 1 | 0.2 |
| 2 | A | 346 | 441 | 28.6 | 0.1 | 0.78 | 0.9 | 27 | 29 | 365 | 3 | 0.6 |
| 3 | A | 354 | 446 | 28.9 | 0.1 | 0.79 | 0.9 | 26 | 28 | 369 | 4 | 0.4 |
| 4 | A | 367 | 486 | 28.4 | 0.6 | 0.76 | 0.9 | 28 | 28 | 382 | 3 | 0.6 |
| 5 | A | 361 | 451 | 28.6 | 0.6 | 0.80 | 1.0 | 29 | 29 | 386 | 3 | 0.4 |
| 6 | A | 301 | 446 | 29.2 | 0 | 0.67 | 1.0 | 28 | 61 | 311 | 1 | 0 |
| 7 | A | 226 | 447 | 30.1 | 0 | 0.51 | 1.4 | 60 | 61 | 226 | 1 | 0.1 |

Example 2

Example 1 was repeated using the steel compositions shown in Table 6.

In this example, a cold-rolled steel sheet was zinc-coated with a coating of 45 g/m$^2$ after being heated to 860° C. After galvanizing, galvannealing (alloying) was carried out. The resulting sheet was evaluated with respect to tensile properties, and BH. Properties after accelerated aging at 50° C. for 3 days were also evaluated.

The results are shown in Table 7.

TABLE 6

| Steel Type | C | Si | Mn | P | S | Al | N | Mo | Cr | Ti | Nb | B |
|---|---|---|---|---|---|---|---|---|---|---|---|---|
| A1 | 0.0020 | 0.01 | 2.45 | 0.021 | 0.001 | 0.050 | 0.0035 | 0.05 | — | — | 0.035 | — |
| A2 | 0.0034 | 0.01 | 2.22 | 0.016 | 0.003 | 0.021 | 0.0025 | 0.06 | 0.02 | — | — | — |
| A3 | 0.0031 | 0.02 | 2.01 | 0.017 | 0.006 | 0.023 | 0.0028 | 0.03 | 0.03 | 0.053 | — | — |
| A4 | 0.0031 | 0.12 | 1.82 | 0.018 | 0.002 | 0.035 | 0.0033 | 0.10 | — | — | — | — |
| A5 | 0.0057 | 0.01 | 1.52 | 0.013 | 0.001 | 0.033 | 0.0064 | 0.20 | 0.28 | 0.040 | — | 0.0009 |
| A6 | 0.0089 | 0.01 | 1.61 | 0.015 | 0.002 | 0.038 | 0.0035 | 0.20 | 0.30 | — | — | 0.0012 |

TABLE 7

| | | Tensile Properties | | | | | BH Properties | Properties After Aging | | |
|---|---|---|---|---|---|---|---|---|---|---|
| Run No. | Steel Type | YP (MPa) | TS (MPa) | EL (%) | YPE (%) | r⁻ Value | BH (MPa) | ΔYS (MPa) | ΔYPE (%) | ΔEl (%) |
| 1 | A1 | 213 | 421 | 39.3 | 0.0 | 1.53 | 81 | 2 | 0.0 | 0.0 |
| 2 | A2 | 193 | 405 | 40.1 | 0.0 | 1.48 | 93 | 1 | 0.0 | 0.0 |
| 3 | A3 | 161 | 354 | 44.5 | 0.0 | 1.74 | 84 | 2 | 0.0 | −0.1 |
| 4 | A4 | 164 | 359 | 43.7 | 0.0 | 1.51 | 89 | 3 | 0.0 | −0.2 |
| 5 | A5 | 186 | 372 | 42.5 | 0.0 | 1.69 | 106 | 1 | 0.0 | −0.3 |
| 6 | A6 | 238 | 403 | 40.3 | 0.0 | 1.53 | 61 | 1 | 0.0 | −0.2 |

As can be seen from the above, a high strength zinc-coated steel sheet according to the present invention has workability, i.e., press-formability in an improved level not found in the prior art, and excellent shape retention and dent resistance. Therefore, it can permit a decrease in the thickness of panels and other members for the exterior of automobiles, thereby providing significant decreases in cost and weight.

What is claimed is:

1. A steel comprising, in mass %, C: less than 0.02%, Si: at most 0.4%, Mn: 0.5–3.0%, P: at most 0.15%, S: at most 0.03%, Al: at most 0.50%, N: at most 0.01%, and Mo: 0.01–1.0%.

2. A steel as claimed in claim 1 further comprising at least one of Cr: less than 1.5%, Ti: at most 0.15%, Nb: at most 0.15%, and B: at most 0.01%.

3. A steel as claimed in claim 1 having a metal structure containing retained austenite with a volume ratio of at least 0.5% and less than 10%, and a remainder which is a multi-phase structure of ferrite and a hard phase of at least one of bainite and martensite.

4. A steel as claimed in claim 2 having a metal structure containing retained austenite with a volume ratio of at least 0.5% and less than 10%, and a remainder which is a multi-phase structure of ferrite and a hard phase of at least one of bainite and martensite.

5. A high strength cold rolled steel sheet formed from the steel of claim 1.

6. A high strength cold rolled steel sheet formed from the steel of claim 2.

7. A high strength cold rolled steel sheet formed from the steel of claim 3.

8. A high strength cold rolled steel sheet formed from the steel of claim 4.

9. A high strength cold rolled steel sheet comprising, in mass %, C: less than 0.02%, Si: at most 0.4%, Mn: 0.5–3.0%, P: at most 0.15%, S: at most 0.03%, Al: at most 0.50%, N: at most 0.01%, and Mo: 0.01–1.0%, wherein in a tensile test in a direction perpendicular to the rolling direction, the yield point is at most 300 MPa, the amount of work hardening and the amount of BH with a 2% prestrain are both at least 30 MPa, and a yield ratio is at most 75%.

10. A high strength cold rolled steel sheet comprising, in mass %, C: less than 0.02%, Si: at most0.4%, Mn: 0.5–3.0%, P: at most 0.15%, S: at most 0.03%, Al: at most 0.50%, N: at most 0.01%, Mo: 0.01–1.0%, and at least one of Cr: less than 1.5%, Ti: at most 0.15%, Nb: at most 0.15% and B: at most 0.01%, wherein in a tensile test in a direction perpendicular to the rolling direction, the yield point is at most 300 MPa, the amount of work hardening and the amount of BH with a 2% prestrain are both at least 30 MPa, and a yield ratio is at most 75%.

11. A high strength zinc-coated steel sheet in which a zinc coating is provided on the high strength cold rolled steel sheet claimed in claim 5.

12. A high strength zinc-coated steel sheet in which a zinc coating is provided on the high strength cold rolled steel sheet claimed in claim 6.

13. A method of manufacturing a high strength zinc-coated steel sheet comprising casting a slab of the steel claimed in claim 1, performing hot rough rolling either directly or after heating to a temperature of at most 1300° C., commencing hot finish rolling either directly or after reheating or holding, completing finish rolling at a temperature of at least 780° C., performing coiling after cooling to a temperature of 750° C. or below at an average cooling rate of at least 3° C./second, heating to an annealing temperature of at least 700° C. and then cooling to a temperature of 600° C. or below at an average cooling rate of at least 3° C./second, then holding in a temperature range of 450–600° C. for at least 10 seconds, and performing hot dip galvanizing after cooling.

14. A method as claimed in claim 13 in which after coiling but before annealing, cold rolling is performed either directly or after scale removal.

15. A method as claimed in claim 13 in which alloying is carried out after galvanizing.

16. A method of manufacturing a high strength zinc-coated steel sheet comprising casting a slab of the steel claimed in claim 2, performing hot rough rolling either directly or after heating to a temperature of at most 1300° C., commencing hot finish rolling either directly or after reheating or holding, completing finish rolling at a temperature of at least 780° C., performing coiling after cooling to a temperature of 750° C. or below at an average cooling rate of at least 3° C./second, heating to an annealing temperature of at least 700° C. and then cooling to a temperature of 600° C. or below at an average cooling rate of at least 3° C./second, then holding in a temperature range of 450–600° C. for at least 10 seconds, and performing hot dip galvanizing after cooling.

17. A method as claimed in claim 16 in which after coiling but before annealing, cold rolling is performed either directly or after scale removal.

18. A method as claimed in claim 16 in which alloying is carried out after galvanizing.

19. A method of manufacturing a high strength steel sheet comprising casting a slab of the steel claimed in claim 1, performing hot rough rolling either directly or after heating to a temperature of at most 1300° C., commencing hot finish rolling either directly or after reheating or holding, completing finish rolling at a temperature of at least 780° C., performing coiling after cooling to a temperature of 750° C. or below at an average cooling rate of at least 3° C./second, heating to an annealing temperature of at least 700° C. and then cooling to a temperature of 600° C. or below at an average cooling rate of at least 3° C./second, then holding in a temperature range of 250–600° C. for at least 10 seconds, and then cooling.

20. A method as claimed in claim 19 in which after coiling but before, annealing, cold rolling is performed either directly or after scale removal.

21. A method of manufacturing a high strength steel sheet comprising casting a slab of the steel claimed in claim 2, performing hot rough rolling either directly or after heating to a temperature of at most 1300° C., commencing hot finish rolling either directly or after reheating or holding, completing finish rolling at a temperature of at least 780° C., performing coiling after cooling to a temperature of 750° C. or below at an average cooling rate of at least 3° C./second, heating to an annealing temperature of at least 700° C. and then cooling to a temperature of 600° C. or below at an average cooling rate of at least 3° C./second, then holding in a temperature range of 250–600° C. for at least 10 seconds, and then cooling.

22. A method as claimed in claim 21 in which after coiling but before annealing, cold rolling is performed either directly or after scale removal.

23. A method of manufacturing a high strength zinc-coated steel sheet comprising electroplating the surface of a steel sheet obtained by the method claimed in claim 19 with a metal or an alloy having zinc as a primary component.

24. A steel as claimed in claim 1, wherein Mn: at most 1.45%.

25. A steel as claimed in claim 1, the steel having a structure which contains 0.5 to less than 10% by volume of retained austenite.

26. A steel comprising, in mass %, C: at most 0.04%, Si: at most 0.4%, Mn: 0.5–1.45%, P: at most 0.15%, S: at most 0.03%, Al: at most 0.50%, N: at most 0.01% and Mo: 0.01–1.0%, the steel having a structure which contains 0.5 to less than 10% by volume of retained austenite.

27. A high strength cold rolled steel sheet comprising, in mass %, C: at most 0.04%, Si: at most 0.4%, Mn: 0.5–3.0%, P: at most 0.15%, S: at most 0.03%, Al: at most 0.50%, N: at most 0.01%, and Mo. 0.01–1.0%, wherein in a tensile test in a direction perpendicular to the rolling direction, the yield point is at most 300 MPa, the amount of work hardening and the amount of BH with a 2% prestrain are both at least 30 MPa, and the yield ratio is at most 75%, and the steel has a structure which contains 0.5 to less than 10% by volume of retained austenite.

28. A high strength cold rolled steel sheet comprising, in mass %, C: at most 0.04%, Si: at most 0.4%, Mn: 0.53.0%, P: at most 0.15%, S: at most 0.03%, Al: at most 0.50%, N: at most 0.01%, and Mo: 0.01–1.0%, and at least one of Cr: less than 1.5%, Ti: at most 0.15%, Nb: at most 0.15% and B: at most 0.01% as claimed in claim 6 wherein in a tensile test in a direction perpendicular to the rolling direction, the yield point is at most 300 MPa, the amount of work hardening and the amount of BH with a 2% prestrain are both at least 30 MPa, and the yield ratio is at most 75%, and the steel has a structure which contains 0.5 to less than 10% by volume of retained austenite.

* * * * *

UNITED STATES PATENT AND TRADEMARK OFFICE

CERTIFICATE OF CORRECTION

PATENT NO. : 6,586,117 B2
DATED : July 1, 2003
INVENTOR(S) : Shigeki Nomura et al.

It is certified that error appears in the above-identified patent and that said Letters Patent is hereby corrected as shown below:

Column 16,
Line 35, change "Mn: 0.53.0%" to -- Mn: 0.53-3.0% --.

Signed and Sealed this

Sixth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,586,117 B2
DATED : July 1, 2003
INVENTOR(S) : Shigeki Nomura et al.

It is certified that error appears in the above-identified patent and that said Letters Patent is hereby corrected as shown below:

Column 16,
Line 35, change "Mn: 0.53.0%" to -- Mn: 0.5-3.0% --.

This certificate supersedes Certificate of Correction issued on July 6, 2004.

Signed and Sealed this

Twenty-third Day of November, 2004

JON W. DUDAS
*Director of the United States Patent and Trademark Office*